US010434790B2

(12) United States Patent
Bravo de Vega et al.

(10) Patent No.: US 10,434,790 B2
(45) Date of Patent: Oct. 8, 2019

(54) DROPLET DETECTION

(71) Applicants: Hewlett-Packard Development Company, L.P., Houston, TX (US); Jose Francisco Bravo de Vega, Sant Cugat del Valles (ES); Francisco Gomez, Sant Cugat del Valles (ES); Jordi Bas, Sant Cugat del Valles (ES)

(72) Inventors: Jose Francisco Bravo de Vega, Sant Cugat del Valles (ES); Francisco Gomez, Sant Cugat del Valles (ES); Jordi Bas, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,953

(22) PCT Filed: Dec. 17, 2015

(86) PCT No.: PCT/EP2015/080364

§ 371 (c)(1),
(2) Date: Mar. 16, 2018

(87) PCT Pub. No.: WO2017/102016

PCT Pub. Date: Jun. 22, 2017

(65) Prior Publication Data

US 2018/0264840 A1 Sep. 20, 2018

(51) Int. Cl.
*B41J 2/21* (2006.01)
*B41J 2/165* (2006.01)
(Continued)

(52) U.S. Cl.
CPC ..... *B41J 2/2142* (2013.01); *B41J 2/04* (2013.01); *B41J 2/125* (2013.01); *B41J 2/16579* (2013.01)

(58) Field of Classification Search
CPC ... B41J 2/2142; B41J 2/04; B41J 2/125; B41J 2/16579
See application file for complete search history.

(56) References Cited

U.S. PATENT DOCUMENTS 6,641,246 B2 11/2003 Endo et al.
7,942,494 B2 5/2011 Hayashi et al.
(Continued)

FOREIGN PATENT DOCUMENTS

EP 2145768 1/2010
JP 2003320650 11/2003
(Continued)

OTHER PUBLICATIONS

Tröndle, J., A. Ernst, W. Streule, R. Zengerle, and P. Koltay. "Non-contact optical sensor to detect free flying droplets in the nanolitre range." Sensors and Actuators A: Physical 158, No. 2 (2010): 254-262.

*Primary Examiner* — Lamson D Nguyen
(74) *Attorney, Agent, or Firm* — HP Inc. Patent Department

(57) ABSTRACT

Apparatus to detect droplets and methods for detecting droplets are described. The apparatus comprise a light emitter and a light detector. The light emitter is to emit light along an optical axis, the light having a spatial intensity distribution profile with a peak that is non-coincident with the optical axis. The light detector is located relative to the light emitter such that, in use, the peak of the spatial intensity distribution profile is incident on the light detector.

20 Claims, 7 Drawing Sheets

(51) Int. Cl.
*B41J 2/04* (2006.01)
*B41J 2/125* (2006.01)

(56) References Cited

U.S. PATENT DOCUMENTS

| | | | | |
|---|---|---|---|---|
| 8,870,335 | B2 | 10/2014 | Andoh | |
| 9,676,183 | B1 * | 6/2017 | Mielgo | B41J 2/0456 |
| 2013/0077099 | A1 | 3/2013 | Mochizuki | |
| 2015/0009252 | A1 | 1/2015 | Andoh et al. | |
| 2015/0177136 | A1 * | 6/2015 | Andoh | G01N 21/47 356/343 |
| 2015/0290929 | A1 | 10/2015 | Ando | |

FOREIGN PATENT DOCUMENTS

| | | |
|---|---|---|
| JP | 2009113225 | 5/2009 |
| JP | 2014034157 | 2/2014 |

* cited by examiner

DROPLET DETECTION

BACKGROUND

Inkjet printing propels droplets of printing fluid onto media to create an image on a substrate in a 2D printing device, or a layer of an object in a build material in a 3D printing device. For example, an inkjet printer may comprise a printhead comprising an ink drop generator, or plural ink drop generators, that propel the printing fluid through an aperture, or nozzle, to eject a droplet of printing fluid onto the media.

Reliable printing operation in part requires reliable operation of the nozzles. If a nozzle were to malfunction, printing fluid may not be properly ejected, which can have a negative impact on the quality of the printed image or object. Failure mechanisms of the nozzles may include a malfunction of the resistive element, a blockage of an ink supply line, a blockage in the firing chamber, and/or a blockage in the aperture.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1:
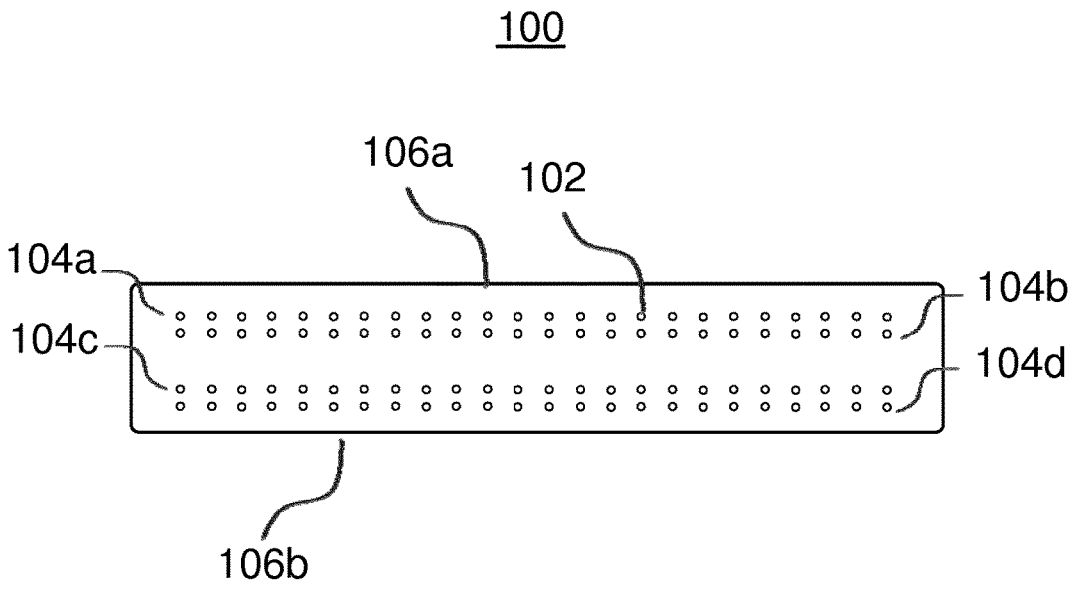
FIG. 1 is a schematic diagram of a ink drop generator.

FIG. 1 schematically illustrates the components of an ink drop generator 100 which may be used in a printhead in a 2D printer or a 3D printer. The ink drop generator 100 comprises a nozzle 102 or plural nozzles 102. The operation of the ink drop generators is described below with reference to FIGS. 2*a* to 2*c*. In the example shown in FIG. 1, the ink drop generator 100 comprises four rows 104*a*-104*d* of nozzles 102. Two of the rows 104*a*, 104*b* are located near a leading edge 106*a* of the ink drop generator 100 and the other two rows 104*c*, 104*d*, are located near a trailing edge 106*b* of the ink drop generator 100. Each of the rows 104*a*-104*d* may have its own supply of printing fluid, referred to herein as ink.

Each of the nozzles 102 may eject ink onto a media layer to create an image on a substrate in a 2D printing device, or a layer of an object in a build material in a 3D printing device (both referred to herein as the image). The media layer is referred to herein as a substrate.

The image is communicated to the printer in digital form. The image may include any combination of text, graphics and images. In certain implementations, each printhead or each ink drop generator 100 may have a controller that receives data from an image processing unit (not shown). The data received by the controller is used to control how ink is ejected from the nozzles 102 to print the image.

Any suitable form of substrate may be used, including, amongst others, single media sheets and/or continuous rolls. The substrate 104 may be formed of any suitable material such as, amongst others, plain paper, glossy paper, coated paper, transparencies, polymers, metal foils etc. In 3D printing the substrate may be a build material, such as a layer of powdered material.

Figure 2A:
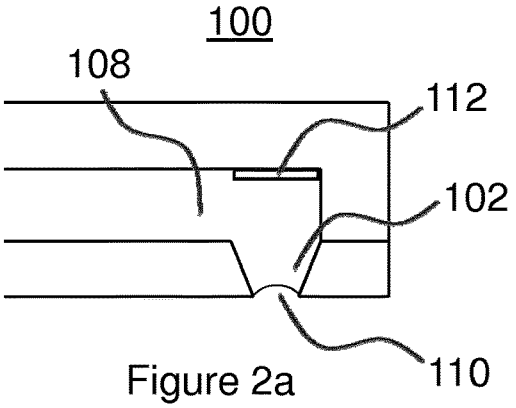
FIG. 2*a* is a schematic diagram showing a cross-section view of an ink drop generator.
Figure 2B:
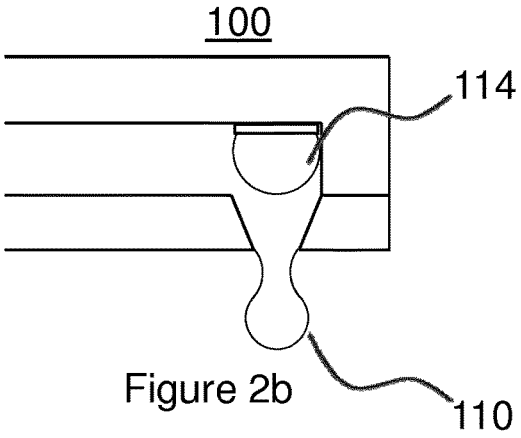
FIG. 2*b* is a schematic diagram showing a cross-section view of an ink drop generator.
Figure 2C:
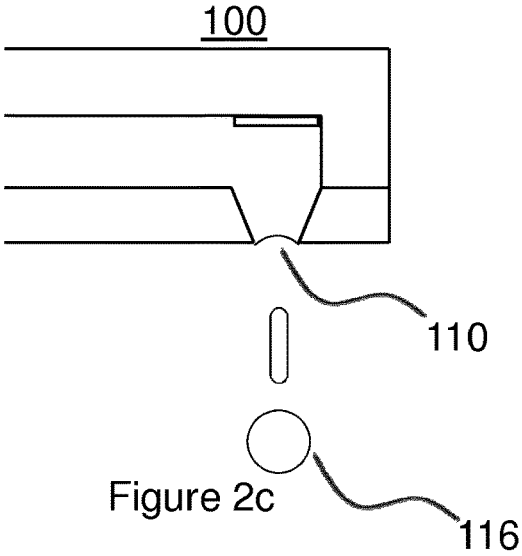
FIG. 2*c* is a schematic diagram showing a cross-section view of an ink drop generator.

FIGS. 2*a*, 2*b* and 2*c* illustrate the components and operation of an example of an ink drop generator 200 for ejecting ink through a nozzle 102 in the printhead. The example ink drop generator 200 shown in FIGS. 2*a* to 2*c* is a thermal inkjet (TIJ) ink drop generator; however, it will be understood that in other examples different mechanisms may be employed to eject ink. For example, the ink drop generator may be a piezo ink drop generator.

As shown in FIG. 2*a*, the ink drop generator 100 comprises a firing chamber 108 and a nozzle 102. During operation, the firing chamber 108 is filled with ink such that the ink forms a meniscus 110 at the nozzle 102. Ink may flow into the firing chamber 108 from an ink reservoir (not shown). Within the firing chamber 108 is located a resistive element 112. FIG. 2*a* shows the ink drop generator 100 when the resistive element 112 is not electrified.

FIG. 2*b* shows the ink drop generator 100 when the resistive element 112 is electrified. When electrified, the temperature of the resistive element 112 increases. As the temperature of the resistive element 112 increases, heat is transferred to ink in the firing chamber 108 adjacent the resistive element 112. This may cause a bubble 114 to form in the firing chamber 108 at or near the location of the resistive element 112. As the bubble 114 expands ink may be pushed through the nozzle 102 such that the meniscus 110 is expanded.

As shown in FIG. 2*c*, when the surface tension of the meniscus 110 is no longer sufficient to balance the force exerted by the bubble 114, a droplet 116 is ejected from the nozzle 102. The droplet 116 may be a single droplet or plural droplets such as a main droplet followed by a further droplet, as shown in FIG. 2*c*.

Once the droplet 116 is ejected, and current flowing through the resistive element 112 is reduced, the bubble 114 collapses. Collapse of the bubble 114 enables the meniscus 110 to return to the same state as shown in FIG. 2*a* and may cause more ink to be drawn into the firing chamber 108.

Reliable operation of the printer in part requires reliable operation of the ink drop generators 100. If an ink drop generator 100 were to malfunction, then ink that should be ejected from the nozzle 102 onto the substrate is not ejected, which can have a negative impact on the quality of the printed image. Failure mechanisms of an ink drop generator 100 may comprise a malfunction of the resistive element 112, a blockage in an ink supply line from the reservoir, a blockage in the firing chamber 108, and/or a blockage in the nozzle 102.

To determine whether an ink drop generator 100 is operating correctly, it is desirable to determine whether a droplet is ejected from the nozzle 102 when the resistive element 112 is electrified. Described herein are examples of droplet detection apparatuses for a printing device.

In an example, a droplet detection apparatus comprises: a light emitter to emit light along an optical axis, the light having a spatial intensity distribution profile with a peak that is non-coincident with the optical axis; and a light detector located relative to the light emitter such that, in use, the peak of the spatial intensity distribution profile is incident on the light detector.

In another example, a droplet detection apparatus comprises: a light detector comprising a detection aperture having a central axis; and a light emitter to emit a light beam along a propagation axis such that, in use, at least a portion of the light beam is incident on the detection aperture, wherein the propagation axis of the light beam is non-coincident with the central axis of the detection aperture.

In many examples of printing device, the printing device comprises a relatively large number of nozzles 102 spanning a relatively long distance. For example, in a page wide array printer, the printer may comprise tens of thousands of nozzles 102 in a printbar. The printbar may span many tens of centimeters or in some examples more than a meter. In such printing devices, determining whether the nozzles 102 are properly ejecting ink over the whole extent of the printbar may utilize duplication of the droplet detection apparatus. This may present challenges in terms of scaling the light emitters and light detectors and may also present optical challenges. For example, providing relatively large numbers of light emitter-light detector pairs in a relatively small space, may result in interference or so-called "cross-talk" between the light emitter-light detector pairs. Examples described herein help to mitigate such challenges.

Light emitting diodes (LEDs) emitting relatively narrowly divergent beams enable closer placement of one light emitter-light detector pair to an adjacent light emitter-light detector pair. However, when the divergence of a light beam emitted by such an LED is narrowed, the far-field properties of the beam may be different from the properties of relatively wider diverging beams.

Figure 3:
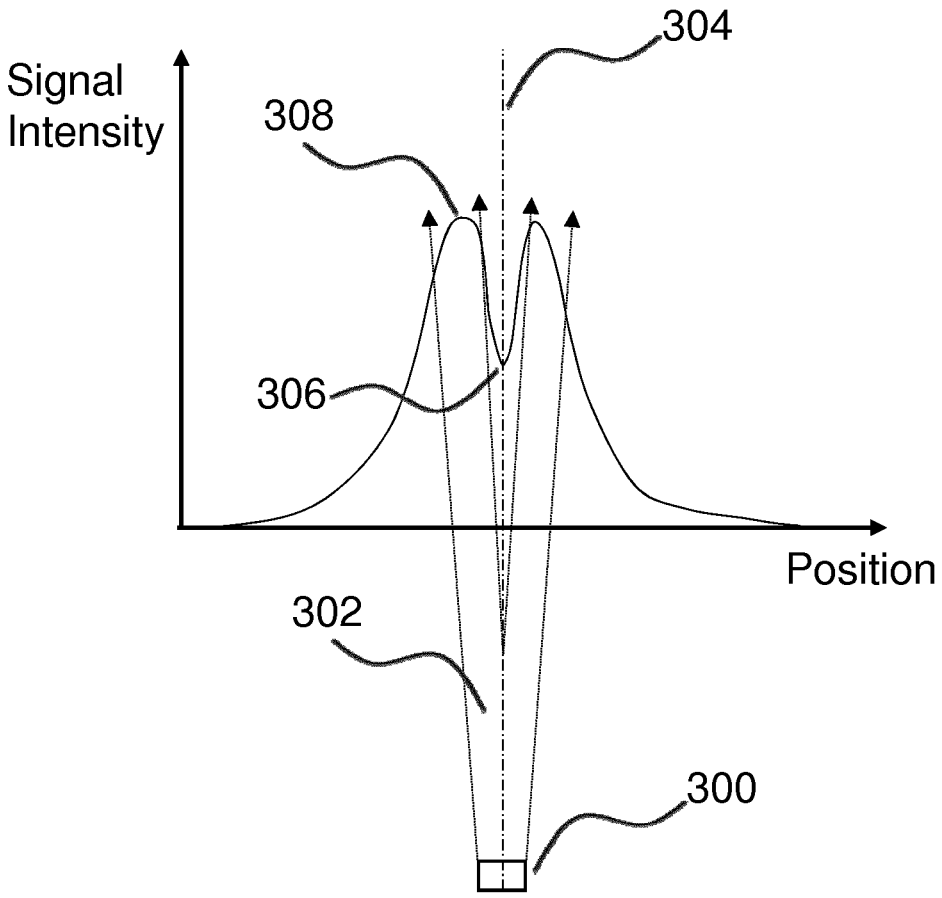
FIG. 3 is a schematic illustration of a spatial intensity distribution profile of a light emitter of an example.

FIG. 3 illustrates a light intensity distribution of a light emitter 300 of an example. In the example shown in FIG. 3, the light emitter 300 is an LED in which the emitted light is relatively highly focused into a narrowly diverging beam 302. In an example, the emitted beam 302 may have an angle of divergence less than 20°. In another example, the emitted beam 302 may have an angle of divergence less than 15°. In another example, the emitted beam 302 may have an angle of divergence less than 10°. In another example, the emitted beam 302 may have an angle of divergence of approximately 6°.

The example shown in FIG. 3 may represent a spatial intensity distribution profile across a cross-section of the beam 302 emitted by the light emitter 300 at a distance of 20 mm from the light emitter 300, for example. However, the example shown in FIG. 3 may equally represent an intensity profile across a cross-section of the beam 302 emitted by a light emitter 300 at a distance that is greater than or less than 20 mm. A central position corresponding substantially with a propagation axis 304 of the beam 302 emitted by the light emitter 300 is shown as a dot-dash line in FIG. 3. The profile shown in FIG. 3 is a cross-section along one axis perpendicular to the propagation axis 302 of the beam 302, but the beam 302 may exhibit a substantially annular cross sectional intensity profile in a plane perpendicular to the propagation axis 304 of the beam 302.

As can be seen from FIG. 3, in such a light emitter 300 there is a significant minima 306 in the spatial intensity distribution profile, the minima 306 corresponding with the propagation axis 304 of the beam 302. A peak 308 of the spatial intensity distribution profile is non-coincident with the propagation axis 304 of the beam 302. This may be caused, for example, by an electrode, that is connected to the light emitter 300 to provide a source of electrical energy, occluding light emitted by the emitter 300. Consequently, light detected by a light detector that is located along the propagation axis 304 of the beam 302 (referred to herein as "on-axis") may generate a lower value signal than light detected by a light detector that is located away from the propagation axis of the beam (referred to herein as "off-axis"). In some examples, a detector located on the propagation axis may be unable to detect enough light emitted by the light emitter to generate a usable signal.

Figure 4A:
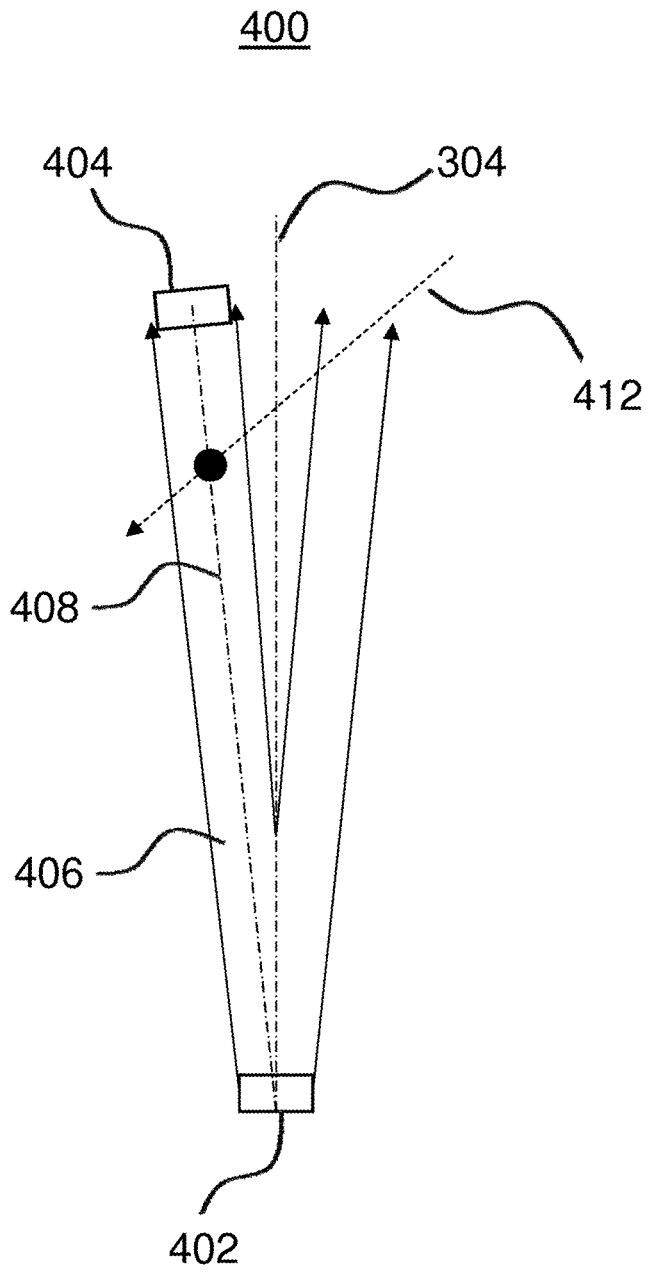
FIG. 4*a* is a schematic diagram showing a droplet detection apparatus according to an example.

FIG. 4*a* illustrates a droplet detection apparatus 400 according to an example. The droplet detection apparatus 400 comprises a light emitter 402 and a light detector 404.

The light emitter 402 may have an intensity profile similar to that shown in FIG. 3. The light emitter 402 may be, for example, an LED. In other examples, the light emitter may be another type of light emitting device, such as a laser.

The light detector 404 may be, for example, a photodiode. In other examples, the light detector 404 may be any suitable device for detecting light. For example, the light detector 404 may be an active pixel sensor, a charge-coupled device or a direct-conversion radiation detector. The light detector 404 may detect light incident from a range of angles incident within an aperture of the light detector 404. The aperture may be a physical window to occlude light outside of an area of detection or may be an optical numerical aperture defined by the surface of the detector 404. The aperture has a central axis 408 about which the detector 404 can detect light within a range of angles.

The light emitter 402 may emit a continuous (i.e. not pulsed) beam 406 of light that is detectable by the light detector 404.

In some examples the light emitter 402 may emit a pulsed beam 406 of light having a pulse frequency that is sufficiently high to reliably detect droplets. For example, the pulse frequency may be greater than 20 kHz.

In some examples, the light emitter 402 may emit a pulsed beam 406 of light extending over a period in which a droplet is ejected. For example, the duration of the pulse may be greater than 25 μs.

The beam 406 may, for example, have a substantially annular cross-sectional profile as described above with reference to FIG. 3 such that the beam 406 forms a cone of light.

The light detector 404 may generate a signal representative of an intensity of light incident on an aperture of the light detector 404. For example, the light detector 404 may generate a voltage signal, a current signal, or a combination of voltage and current signals representative of the intensity of incident light.

As shown in FIG. 4*a*, the light detector 404 is located away from the propagation axis 304 of the beam 406. The light detector 404 may be located relative to the light emitter 402 such that, in use, the peak 308 of the spatial intensity distribution profile is incident on the light detector 404. In other words, in use, at least a portion of the light beam 406 is incident on the aperture of the light detector 404, but the propagation axis 304 of the light beam 406 is non-coincident with the central axis 408 of the aperture of the light detector 404.

In the example shown in FIG. 4*a*, the central axis 408 of the aperture of the light detector 404 is non-coincident and non-parallel with the propagation axis 304 of the light beam 406 emitted by the light emitter 402. In some examples, the light emitter 402 is located such that an angle between the propagation axis 304 of the light beam 406 and the central axis 408 of the detector 404 is approximately half of the angle of divergence of the beam 406. In some examples, the angle between the propagation axis 304 of the light beam 406 and the central axis 408 of the detector 404 may be in the range 2°-4°. For example, the angle between the propagation axis 304 of the light beam 406 and the central axis 408 of the detector 404 may be 3°.

Figure 4B:
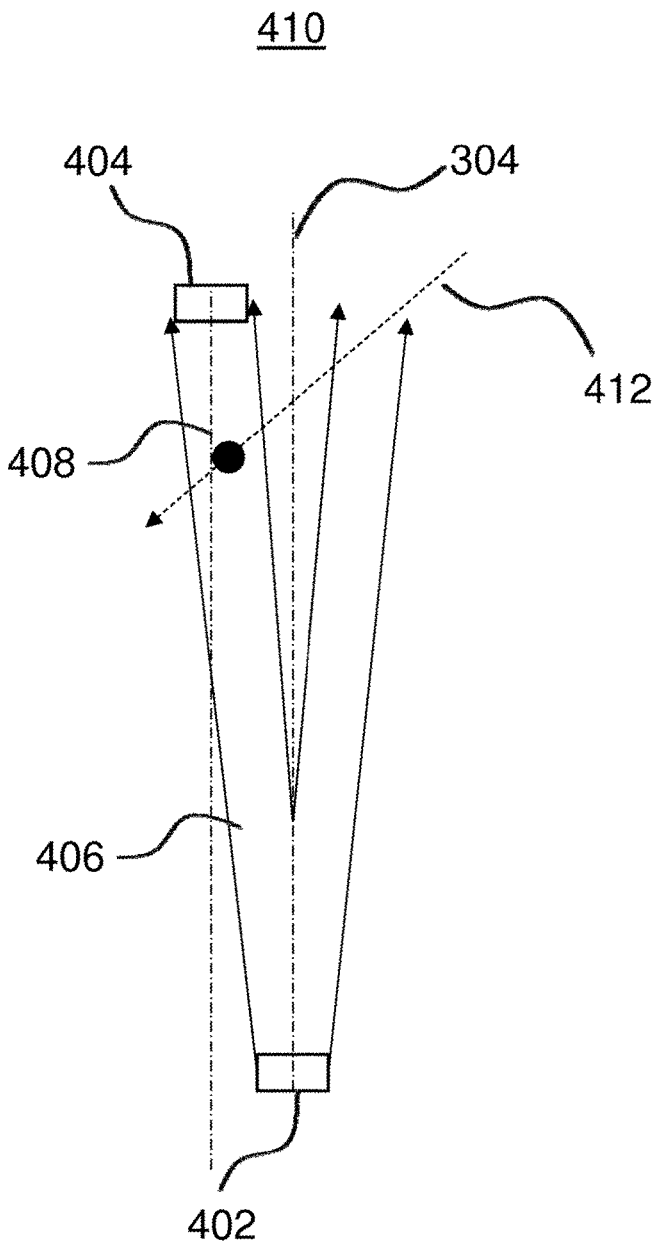
FIG. 4*b* is a schematic diagram showing a droplet detection apparatus according to an example.

FIG. 4*b* illustrates a droplet detection apparatus 410 according to another example. The droplet detection apparatus 410 also comprises a light emitter 402 and a light detector 404.

In the example shown in FIG. 4*b*, the light detector 404 is also located away from the propagation axis 304 of the beam 406 and is located relative to the light emitter 402 such that, in use, the peak 308 of the spatial intensity distribution profile is incident on the light detector 404. In other words, in use, at least a portion of the light beam 406 is incident on the aperture of the light detector 404, but the propagation axis 304 of the light beam 406 is non-coincident with the central axis 408 of the aperture of the light detector 404.

However, in the example shown in FIG. 4*b*, the central axis 408 of the aperture of the light detector 404 is non-coincident and parallel with the propagation axis 304 of the light beam 406 emitted by the light emitter 402.

In the examples described above with reference to FIGS. 4*a* and 4*b*, the drop detection apparatus 400, 410 may include detection circuitry (not shown) to monitor the signal generated by the light detector 404. In some examples, the detection circuitry may be separate to the light detector 404, while in other examples the detection circuitry may be integral with the light detector 404.

When the beam of light emitted by the light emitter 404 is interrupted, the signal generated by the light detector 404 may vary. In turn, the detection circuitry may detect a variation in the signal generated by the light detector 404. For example, the detection circuitry may detect a reduction in a value of the signal generated by the light detector 404 when the beam of light is interrupted. Thus, when the beam 406 of light emitted by the light emitter 402 is interrupted by a droplet of fluid, this may be detected by detecting a variation in the signal generated by the light detector 404.

The position of the light emitter 402 and the light detector 404 may be known to the droplet detection apparatus 400, 410. Similarly, the position of a printhead, ink drop generator 100, or nozzle 102 in relation to the light emitter 402 and/or the light detector 404 may be known to the droplet detection apparatus 400, 410. By knowing the position of a printhead, ink drop generator 100, or nozzle 102 in relation to the light emitter 402 and/or the light detector 404, the droplet detection apparatus 400, 410 can determine whether a droplet is dispensed from a given printhead, ink drop generator 100, or nozzle 102. In this way, the droplet detection apparatus 400, 410 can determine whether a given printhead, ink drop generator 100, or nozzle 102 is functioning correctly.

Figure 5:
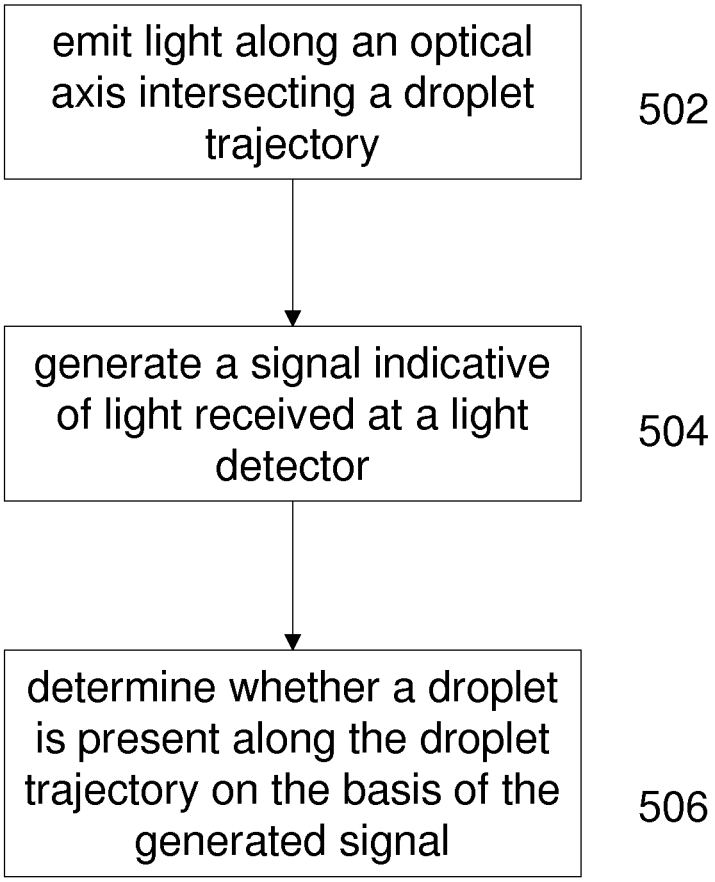
FIG. 5 is a flow diagram showing a method of detecting droplets according to an example.

For example, the droplet detection apparatus 400, 410 may perform a test operation in which a known inkjet droplet generator 100 may be operated to dispense a printing fluid along a droplet trajectory 412 (indicated by a dashed arrow in FIGS. 4*a* and 4*b*). The test operation may comprise a method of detecting droplets 500 as depicted in FIG. 5.

At block 502, the light emitter 402 may emit light along an optical axis corresponding to the propagation axis 304. The light may intersect the droplet trajectory 412. The light may have a spatial intensity distribution profile with a peak intensity that is non-coincident with the optical axis.

At block 504, the light detector 404 may generate a signal indicative of light received at the light detector 404. The light detector 404 may be located relative to the light emitter 402 such that, in use, the peak of the spatial intensity distribution profile is incident on the light detector 404.

At block 506, the droplet detection apparatus 400, 410 may determine whether a droplet is present along the droplet trajectory 412 on the basis of the signal generated by the light detector 404. For example, the droplet detection apparatus 400, 410 may monitor the signal generated by the light detector 404 for a variation indicative of the presence of a droplet, which in turn is indicates that a droplet has been ejected from the nozzle 102 of an operated ink drop generator 100.

The droplet detection apparatus 400, 410 may operate different ink drop generators 100 in a sequence, noting whether the presence of a droplet is detected as each ink drop generator 100 is operated. The ink drop generators 100 may be operated sequentially, for example. In some examples, the ink drop generators 100 may be operated in a pseudo-random order in order to minimize fluidic interference between droplets.

Locating the light detector 404 with respect to the light emitter 402 such that, in use, light emitted by the light emitter 402 has a spatial intensity distribution profile with a peak that is non-coincident with the propagation axis 304, and such that the peak of the spatial intensity distribution profile of light emitted by the light emitter 402 is incident on the light detector 404, enables plural droplet detection apparatuses 400, 410, as described with reference to FIGS. 4*a* and 4*b*, to be located close to one another. Similarly, locating the light detector 404 with respect to the light emitter 402 such that, in use, the propagation axis 304 of the light beam is non-coincident with the central axis 408 of the detection aperture of the light detector 404, enables plural droplet detection apparatuses 400, 410, as described with reference to FIGS. 4*a* and 4*b*, to be located close to one another. This further enables scalability of the droplet detection apparatus 400, 410 by adding further droplet detection apparatuses 400, 410 in a modular manner.

Figure 6:
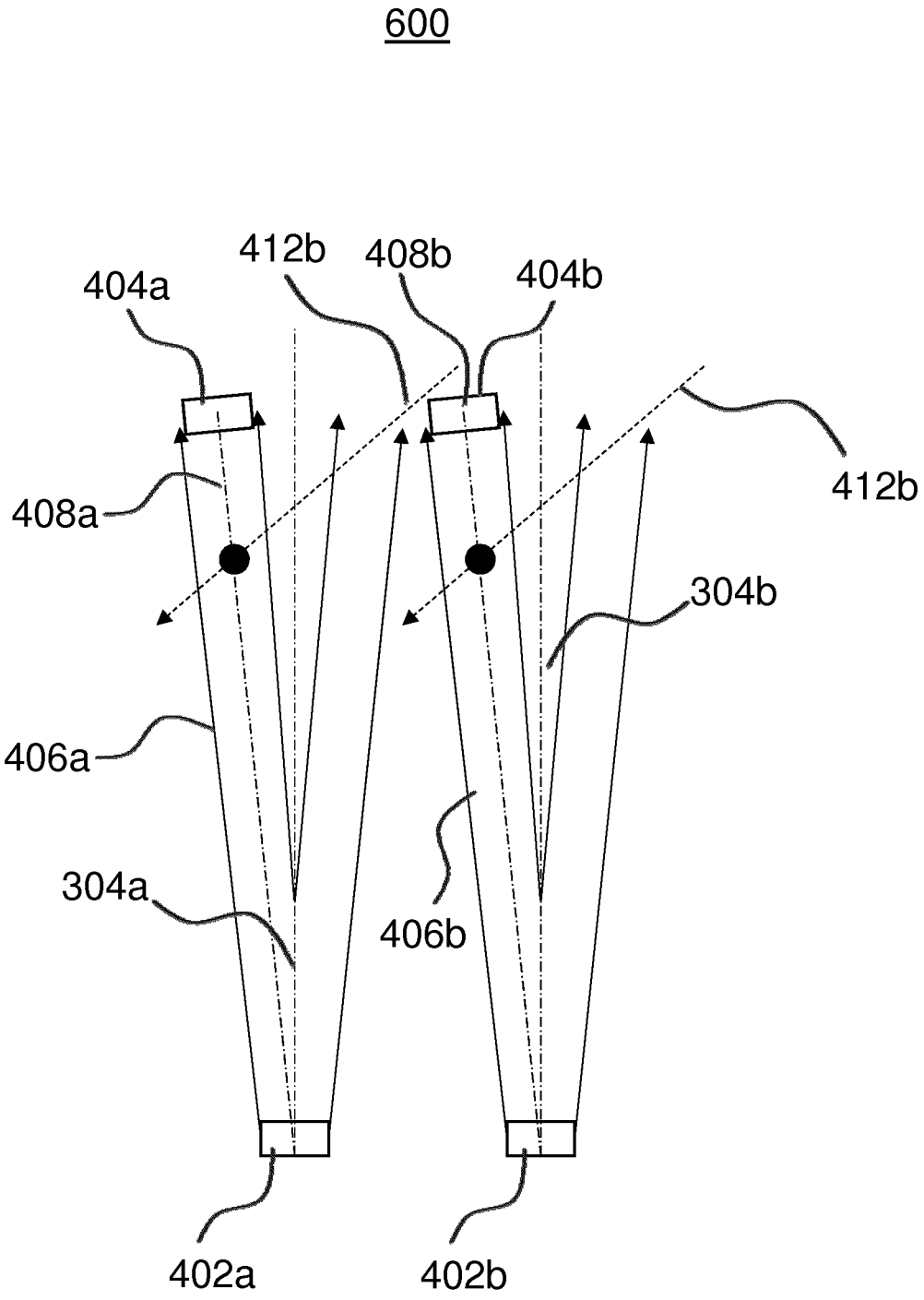
FIG. 6 is a schematic diagram showing a droplet detection apparatus according to an example.

FIG. 6 shows an example of a droplet detection apparatus 600 comprising plural light emitters and plural light detectors.

As shown in FIG. 6, a first light detector 404*a* is to detect light emitted from a first light emitter 402*a*. A second light detector 404*b*, adjacent the first light detector 404*a*, is to detect light emitted from a second light emitter 402*b*, adjacent the first light emitter 402*a*. Light emitted from the first light emitter 402*a* is not detectable by the second light detector 404*b* and light emitted from the second light emitter 402*b* is not detectable by the first light detector 404*a*.

In this way a droplet on a first droplet trajectory 412*a* interrupts a first beam 406*a* emitted by the first light emitter 402*a*, such that it detected on the basis of a signal generated by the first light detector 404*a*, and a droplet on a second droplet trajectory 412*b* interrupts a second beam 406*b* emitted by the second light emitter 402*b*, such that it detected on the basis of a signal generated by the second light detector 404*b*.

Although the detection apparatus 600 shown in FIG. 6 comprises two light emitters and two light detectors, it will be understood that the detection apparatus 600 may have more than two light emitters and more than two light detectors.

It will be understood that although the central axes 408*a*, 408*b* of the light apertures of the light detectors 404*a*, 404*b* are shown in FIG. 6 to be non-coincident and non-parallel with the propagation axes 304*a*, 304*b* of the light emitters 402*a*, 402*b*, the central axes 408*a*, 408*b* of the light apertures of the light detectors 404*a*, 404*b* could in some examples be non-coincident and parallel with the propagation axes 304*a*, 304*b* of the light emitters 402*a*, 402*b*.

The detection apparatuses disclosed herein may be used in a printing device such as a thermal inkjet printer, a piezo inkjet printer, or any other suitable printing device. The printing device may be a 2D printer for printing an image or a 3D printer for printing an object.

In use with a printing device, the light detectors may be located such that the plane defined by the light detectors is perpendicular with a plane defined by the ink drop generators of the printhead. Correspondingly, the light emitters may be located such that they are non-perpendicular with respect to the plane defined by the ink drop generators of the printhead.

In some examples, the light emitters may be angled away from the printhead to minimize reflection of light emitted by the light emitters by the printhead. However, it will be understood that in other examples, the light emitters may be angled away from the printhead, or may be angled in a direction perpendicular to a normal of the plane defined by the ink drop generators of the printhead.

In some examples, angling of the light emitters such that they are non-perpendicular with respect to the plane defined by the ink drop generators of the printhead may be achieved by mounting the light emitters in an angled mount or locator.

Although, as shown in FIG. 6, the plural light emitters are located in one row and the plural light detectors are located in another row, in some examples light emitters may be located in the same row as light detectors and light detectors may be located in the same row as light emitters. This may enable the light emitter-light detector pairs to be interleaved, so as to reduce the space used between pairs further.

Any feature described in relation to any one example may be used alone, or in combination with other features described, and may also be used in combination with a feature or features of any other of the examples, or any combination of any other of the examples. Furthermore, equivalents and modifications not described above may also be employed.

What is claimed is:

1. A droplet detection apparatus for a printing device, the droplet detection apparatus comprising:

a light emitter to emit light along an optical axis, the light, as emitted from the emitter, having a spatial intensity distribution profile with a peak that is non-coincident with the optical axis; and a light detector located relative to the light emitter such that, in use, the peak of the spatial intensity distribution profile is incident on the light detector.

2. A droplet detection apparatus according to claim 1, wherein the optical axis is non-parallel with a central axis of the light detector.

3. A droplet detection apparatus according to claim 1, wherein the optical axis is parallel with a central axis of the light detector.

4. A droplet detection apparatus according to claim 1, wherein the light emitter is a light emitting diode.

5. A droplet detection apparatus according to claim 4, wherein the light emitting diode is to emit a conical beam of light.

6. A droplet detection signal according to claim 1, wherein the light emitter is to emit a continuous beam of light.

7. A droplet detection apparatus according to claim 1, comprising a processor to determine the presence of a droplet on the basis of a signal generated by the light detector.

8. A droplet detection apparatus according to claim 7, wherein the processor is to determine the presence of a droplet on the basis of a reduction of the signal generated by the light detector.

9. A droplet detector apparatus according to claim 7, wherein the processor is to determine a frequency of detection of droplets.

10. A droplet detection apparatus according to claim 1, comprising plural light emitters and plural light detectors.

11. A droplet detection apparatus according to claim 10, wherein the plural light emitters comprise a first light emitter and a second light emitter adjacent the first light emitter, and the plural light detectors comprise a first light detector and a second light detector adjacent the first light detector, wherein the first light detector is to detect light emitted from the first light emitter and the second light detector is to detect light emitted from the second light emitter, and wherein light emitted from the first light emitter is not detectable by the second light detector and light emitted from the second light emitter is not detectable by the first light detector.

12. The droplet detection apparatus according to claim 1, further comprising an electrode connected to the light emitter to occlude light emitted by the emitter to produce the spatial intensity distribution profile in the light as emitted from the emitter.

13. The droplet detection apparatus according to claim 1, wherein an angle between the optical axis of the light emitter and a central axis of the light detector is half of an angle of divergence of a light beam from the light emitter.

14. A droplet detection apparatus for a printing device, the droplet detection apparatus comprising:

a light detector comprising a detection aperture having a central axis; and a light emitter to emit a light beam along a propagation axis such that, in use, at least a portion of the light beam is incident on the detection aperture, wherein the propagation axis of the light beam is non-coincident with the central axis of the detection aperture; and wherein the propagation axis is parallel to the central axis of the detection aperture.

15. The droplet detection apparatus according to claim 14, wherein the light, as emitted by the emitter, has a spatial intensity distribution profile with a peak that is non-coincident with the propagation axis, but is coincident with the detection aperture of the light detector.

16. The droplet detection apparatus according to claim 15, further comprising an electrode connected to the light emitter to occlude light emitted by the emitter to produce the spatial intensity distribution profile in the light as emitted from the emitter.

17. The droplet detection apparatus according to claim 14, wherein the light emitting diode is to emit a conical beam of light.

18. The droplet detection apparatus according to claim 17, wherein an angle between the propagation axis of the light emitter and the central axis of the light detector is half of an angle of divergence of the light beam from the light emitter.

19. A method of detecting droplets in a printing device, the printing device comprising a printhead to dispense a printing fluid along a droplet trajectory, the method comprising:

emitting light along an optical axis, the optical axis intersecting the droplet trajectory and the light having a spatial intensity distribution profile with a peak intensity that is non-coincident with the optical axis;

generating a signal indicative of light received at a light detector, wherein the light detector is located relative to the light emitter such that, in use, the peak of the spatial intensity distribution profile is incident on the light detector; and determining whether a droplet is present along the droplet trajectory on the basis of the generated signal.

20. The method according to claim 19, wherein the optical axis of the light beam is non-coincident with a central axis of the light detector; and wherein the optical axis is parallel to the central axis of the light detector.

* * * * *